United States Patent [19]

Budny et al.

[11] Patent Number: 4,524,120

[45] Date of Patent: Jun. 18, 1985

[54] PROCESS FOR CHARGING TONER COMPOSITIONS

[75] Inventors: Thomas J. Budny, Ontario; William H. Hollenbaugh, Jr.; Edward J. Gutman, both of Webster, all of N.Y.

[73] Assignee: Xerox Corporation, Stamford, Conn.

[21] Appl. No.: 582,211

[22] Filed: Feb. 21, 1984

[51] Int. Cl.[3] ..... G03G 9/10

[52] U.S. Cl. ..... 430/137

[58] Field of Search ..... 430/137

[56] References Cited

U.S. PATENT DOCUMENTS

| | | | |
|---|---|---|---|
| 3,833,366 | 9/1974 | Madrid et al. | 96/1 SD |
| 3,922,381 | 11/1975 | Datta | 427/21 |
| 3,922,382 | 11/1975 | Kukla et al. | 427/58 |
| 3,970,571 | 7/1976 | Olson et al. | 430/137 |
| 4,073,980 | 2/1978 | Westdale et al. | 428/404 |
| 4,225,660 | 9/1980 | Russell, Jr. | 430/108 |
| 4,304,830 | 12/1981 | Bolte et al. | 430/137 |
| 4,378,420 | 3/1983 | Gruber et al. | 430/120 |

*Primary Examiner*—John D. Welsh
*Attorney, Agent, or Firm*—E. O. Palazzo

[57] ABSTRACT

An improved process for rapidly charging toner particles which comprises (I) adding uncharged replenishment toner particles to a charged developer composition comprised of carrier particles and toner particles, the carrier particles consisting of a core containing a continuous polymer coating thereover having incorporated therein a fluoropolymer, contained on from about 1 percent to about 20 percent of the surface area of the coating, (II) contacting the charged developing composition containing said carrier particles with uncharged toner particles wherein charges are transferred to the uncharged toner particles within a mixing period of from about 5 seconds to about 5 minutes, thereby resulting in substantially the same level of charge intensity for said uncharged toner particles as the charge intensity for the charged toner particles in the charged developer composition, which charge intensity for example is from about 5 microcoulombs per gram to about 50 microcoulombs per gram of toner particles.

16 Claims, No Drawings

PROCESS FOR CHARGING TONER COMPOSITIONS

BACKGROUND OF THE INVENTION

This invention is generally directed to a process for rapidly charging uncharged toner particles, and more specifically, the present invention is directed to an improved process for rapidly charging uncharged toner particles added to a charged developer composition. In one embodiment of the present invention, there is provided a process for rapidly charging uncharged toner particles by incorporating into the developer mixture carrier particles containing a coating thereover which is embedded with certain materials such as fluoropolymers. Accordingly, in accordance with the process of the present invention, uncharged toner particles will acquire a charge of the appropriate intensity, and polarity, within a period of less than about five minutes.

The electrostatographic process and more specifically the xerographic process, is well known, as documented in several prior art references. In these processes, an electrostatic latent image is developed by applying toner particles thereto, using for example, cascade development, magnetic brush development, powder cloud development, and the like. For acceptable development to occur, the toner particles must be triboelectrically charged to an appropriate charge intensity, and to the desired polarity, either positive or negative depending for example, on the charge residing on the photoreceptor surface. With recently developed layered photoresponsive devices containing photogenerating layers, and charge transport layers, the surface of the device is charged negatively, necessitating the use of toner particles charged positively. Toner compositions can be prepared so as to assume a positive triboelectric charge by incorporating into the developer compositions involved, various charge enhancing additives including alkylpyridinium halides, various quaternary ammonium compounds, organic sulfates, organic sulfonates, and the like.

Moreover, it is known that new replenishment toner particles added to a developer composition contained in a commercial electrophotographic device, have essentially neutral average charge. Thus this toner must be charged to an appropriate level, which generally involves substantial mixing of the replenishment toner particles with the developer composition for a period of time equal to or greater than about 15 minutes. This time delay is undesirable as the replenishment toner particles can be printed out as background and the electrical properties of the developer composition can be adversely affected to the extent that images of low quality and low resolution result, and in some instances, development does not occur. Also, replenishment toner particles not charged to the appropriate polarity and magnitude can cause contamination as a result of the deposition of such particles on machine parts, thereby eventually resulting in the failure of charging corotrons, filters, and the like.

There is described in U.S. Pat. No. 4,304,830, the disclosure of which is totally incorporated herein by reference, a process for rapidly charging uncharged toner particles added to a developer composition, containing toner particles and carrier particles, wherein there is included in the developer composition an alkylpyridinium compound. As indicated in this patent, rapid charging of uncharged toner particles or admix charging, is accomplished within 2 to 3 minutes, as compared to a charging time of greater than 15 minutes for the acquiring of charges for uncharged toner particles which did not contain the alkylpyridinium halide material.

Additionally there is described in U.S. Pat. No. 4,378,420, the disclosure of which is normally incorporated herein by reference, a process for rapidly charging uncharged replenishment toner particles to a positive polarity wherein there is incorporated in the developer composition carrier particles consisting of a core containing a polymer coating thereon, and having incorporated therein an additive such as a perfluorooctonic acid, 2,4-dinitrophenol, 2,4,6-trinitrophenol, and naphthalene sulfonic acids. According to the disclosure of this application the uncharged toner particles acquire a positive charge within a mixing period of from about 5 seconds to about 5 minutes, thereby resulting in substantially the same level of positive charge intensity for the uncharged toner particles as the charge intensity of the toner particles in the charged developer composition.

Furthermore, disclosed in U.S. Pat. No. 4,073,980 are treated carrier particles which can be used in developer mixtures for the purpose of increasing the useful life of the developer, and also to provide desired triboelectric properties. In accordance with the disclosure of this patent, there is adhered to the surface of the carrier particle a mixture of a perfluorocarboxylic acid or derivatives thereof, and a dry lubricant such as molybdenum sulfide. This coating was found to result in carriers having a longevity and an abrasion resistance which is significantly greater than untreated carrier particles, or carrier particles coated with perfluorocarboxylic acid itself, and further the triboelectric properties of the developer composition containing such carriers was vastly improved over particles coated with similar materials.

In U.S. Pat. No. 3,922,381, there is disclosed carrier particles for use in electrophotographic processes, wherein the carrier particles contain a coating of a perfluorocarboxylic acid. With these coatings there results carrier particles having a longevity which is significantly greater than untreated carrier particles, or carrier particles coated with various other polymers. This patent further discloses that the resulting carrier particles are capable of imparting a positive triboelectric charge to electroscopic powders mixed therewith.

In U.S. Pat. No. 3,922,382, there is disclosed a method for selectively controlling the magnitude of the triboelectric characteristics of carrier particles for use in developer compositions, wherein the carrier particles containing various coatings, such as fluoropolymers are heated to certain temperatures. According to the disclosure of this patent, a coating containing a mixture of a fluoropolymer and a modifying material is effective in obtaining the desired polarity and magnitude of triboelectric charge on the toner particles and the carrier particles.

While the U.S. patents referred to herein describe rapid admix charging, there continues to be a need for improved processes wherein new uncharged replenishment toner particles added to a charged developer composition can acquire charge at the appropriate level and magnitude within a period of mixing time, that is less than about 5 minutes. This mixing time is referred to herein as fast, or rapid admix charging. Additionally, it would be desirable to accomplish rapid admix charging without introducing chemically active materials such as complex charge control additives into the developer composition, or more specifically into the toner resins.

SUMMARY OF THE INVENTION

It is an object of the present invention to provide a process for rapidly charging uncharged toner particles.

In a further object of the present invention there is provided a process for rapidly charging uncharged toner particles to a positive polarity.

In another object of the present invention there is provided a process for the rapid charging within a period of less then about 5 minutes, of uncharged toner particle.

In yet another object of the present invention there are provided processes for rapidly charging uncharged toner particles to an appropriate magnitude and polarity, by incorporating into the developer mixture carrier particles containing in the polymer coating fluoropolymers.

In another object of the present invention there is provided processes for developing electrostatic latent images wherein the developer compositions selected contain therein coated carrier particles with discrete areas of the coating containing patches of fluoropolymers.

These and other objects of the present invention are accomplished by the provision of an improved process for rapidly charging to a positive polarity uncharged replenishment toner particles which comprises adding uncharged replenishment toner particles to a charged developer composition comprised of carrier particles and toner particles, wherein the carrier particles are comprised of a core, containing a polymeric coating thereon having incorporated therein fluoropolymers.

More specifically, in one embodiment, the present invention is directed to an improved process for rapidly charging uncharged replenishment toner particles to a positive polarity which comprises adding uncharged replenishment toner particles containing toner resin particles and pigment particles, to a charged developer composition comprised of carrier particles and toner particles, wherein the carrier particles are comprised of a core with a polymeric overcoating, containing on the surface thereof from about 0.005 percent by weight of about 0.25 percent by weight of certain fluoropolymers, such as polyvinylidene fluoride, commercially available as Kynar. Thus for example for every 100 grams of carrier particles from about 0.005 grams to about 0.25 grams of fluoropolymer are present. The developer composition containing the coated carrier particles are contacted for example by mixing these particles for a period of from about 5 seconds to about 5 minutes, with the uncharged toner particles which particles are charged within the mixing period thereby resulting in substantially the same level of positive charge intensity for the uncharged toner particles and the toner particles initially contained in the charged developer composition. A typical charge intensity is from about 5 microcoulombs per gram to about 50 microcoulombs per gram, and preferably from about 10 microcoulombs per gram to about 25 microcoulombs per gram. Therefore, in accordance with the improved process of the present invention, new uncharged toner particles being added as replenishment material to a charged developer composition comprised of toner particles and coated carrier particles are rapidly charged when the coated carrier particles of the present invention contain such a developer composition having incorporated therein the fluoropolymers indicated. This is known as rapid admix charging. By admix charging in accordance with the process of the present invention is meant providing the appropriate positive charges, at a rapid rate to new uncharged replenishment toner particles, being added to toner and carrier particles which contain charges thereon.

Typical carrier core materials that may be selected for the process of the present invention include glass, silicon dioxide, methyl methacrylate, flint shot, magnetic materials, iron, steel, ferrite, nickel, mixtures thereof, and the like. The carrier particles selected generally are of an average diameter of from about 30 microns to about 500 microns, enabling these particles to possess sufficient density and inertia to avoid adherance to the electrostatic image during the development process. Adherance of carrier particles to the electrostatographic photoreceptor imaging surface is undesirable as deep scratches are usually formed thereon during cleaning with known devices, including wiper blades, and webs.

Illustrative examples of polymeric coatings for the carrier include known polymeric substances such as polystyrenes, polycarbonates, polyesters, styrene butylmethacrylate copolymers, copolymers of vinylidenefluoride and vinylacetate, commercially available as FPC-461, copolymers of vinylchloride and acrylonitrile, and the like. Preferred coating materials include copolymers of vinylchloride and vinylacetate, and FPC-461.

This coating is continuous in that it is contained on the entire outer portion of the carrier core, as contrasted to a semi-continuous coating which does not develop the complete carrier core. Generally, the coating, which primarily provides protection for the carrier core and also assists in the triboelectric charging of the toner particles is present in a thickness of from about 0.1 microns to about 1.2 microns, and preferably from about 0.5 microns to about 1.0 microns.

An important feature of the process of the present invention resides in the incorporation into the carrier coating of fluoropolymers such as polyvinylidene fluoride, and polytetrafluoroethylenes. Other fluoropolymers may be useful providing the objectives of the present invention are achieved.

The fluoropolymer is attached to the polymeric carrier coating in a non-continuous manner and present in an amount of from about 1.0 percent to about 20 percent of the carrier coating surface area. Accordingly from about 80 percent to about 99 percent of the surface area of the carrier particles contain substantially no fluoropolymer. Thus, the fluoropolymer is present on the carrier coating as discrete particles randomly distributed over a portion of the carrier coating surface. While the thickness of the fluoropolymer coating can vary depending upon a number of factors, including the type of carrier coating selected, and the admix properties desired, this thickness is generally from about 0.2 microns to about 0.6 microns and preferably is from about 0.3 microns to about 0.4 microns.

While it is not desired to be limited by theory it is believed that the fluoropolymer contained on the coated carrier particles of the present invention provide for improved admix charging, in that new replenishment uncharged toner particles being added to certain developer mixtures are rapidly charged, to a positive polarity in a period of less than about 5 minutes, to a charge level of from about 5 microcoulombs per gram to about 50 microcoulombs per gram, as compared to a period for example of about 15 minutes of admix charging time when uncharged toner particles are added to a developer mixture that do not container the coated carrier particles of the present invention.

Illustrative examples of finely divided toner resin particles that are useful for preparing the developer compositions containing the coated carrier particles of the present invention, include various polymeric materials, such as natural and synthetic resins, gum copal, gum sandarac, phenol formaldehyde resins, polystyrene resins, epoxy resins, polyester resins, polyethylene resins, styrene butadiene resins, vinylchloride resins, and copolymers or mixtures thereof. A preferred toner resin material is comprised of a copolymer of styrene and n-butylmethacrylate or a copolymer of styrene and butadiene. Among patents describing electrostatic toner compositions that would be useful in the present invention are U.S. Pat. Nos. 2,569,670, 2,653,308, 3,070,342, Re. 25,136 and 3,590,000, the disclosure of each of these patents being totally incorporated herein by reference. The toner particles selected generally have an average particle diameter of between about 5 microns and about 20 microns.

Incorporated into the toner resin particles are suitable pigments or dyes such as for example, carbon black, nigrosine dye, analine blue, chrome yellow, lamp black, sudan black, and mixtures thereof; or magenta, cyan, or yellow pigments. The pigment or dye is present in the toner resin in a sufficient quantity so as to render it highly colored in order that it will form a uniformly visible image on the recording member. Generally thus the pigment or dye is present in an amount of from about 5 percent by weight to about 30 percent by weight, and preferably from about 5 percent by weight to about 10 percent by weight.

Generally, the developer mixture contains toner particles in concentration of from about 1 part toner to about 10 to 200 parts by weight of carrier material.

The compositions of the present invention are useful for causing the development of electrostatic latent images on various suitable imaging members capable of retaining charge, including conventional photoreceptors, such as selenium, alloys of selenium, including selenium arsenic, selenium tellurium and the like. Additionally, the compositions of the present invention are useful for developing images on layered photoresponsive devices comprised of photogenerating layers and amine transport layers, reference for example, U.S. Pat. No. 4,265,990, the disclosure of which is totally incorporated herein by reference. Examples of photogenerating layers include metal phthalocyanines, metal free phthalocyanines, trigonal selenium, vanadyl phthalocyanines and the like, while examples of transport layers include various diamines, as disclosed in U.S. Pat. No. 4,265,990 patent.

Accordingly, the present invention also envisions the development of electrostatic latent images which comprises causing the formation of an electrostatic latent image on an image bearing member, developing the image with the compositions of the present invention comprised of carrier particles and toner particles, which composition has added thereto uncharged replenishment toner particles, the carrier particles being comprised of a core containing a polymer coating thereon, having incorporated therein a fluoropolymer, wherein the uncharged replenishment toner particles are charged to the appropriate polarity and magnitude by contacting the carrier particles with the uncharged toner particles causing the uncharged toner particles to acquire the appropriate charge within a mixing period of from about 5 seconds to about 5 minutes, thereby resulting in the same level of charge intensity for the toner particles initially contained in the charged developer composition, and the uncharged replenishment toner particles, such charge intensity ranging from about 5 microcoulombs per gram to about 50 microcoulombs per gram, followed by transferring the image to a suitable substrate, and permanently affixing the image thereto.

The following examples are being supplied to further illustrate the various embodiments of the present invention, it being noted that these examples are intended to illustrate and not limit the scope of the present invention. Parts and percentages are by weight unless otherwise indicated.

EXAMPLE I

There was prepared carrier particles by mixing 200 grams of a 100 micron carrier containing a steel core, available from Nuclear Metals Corporation, coated with 0.89 grams of a copolymer of vinylidene fluoride and vinylacetate, commercially available as FPC-461 from Occidental Petroleum, with 0.2 grams (0.1 percent) of polyvinylidene fluoride, commercially available as Kynar 301. Mixing was continued for 30 minutes and subsequently the resulting carrier particles were heated in an oven at 100° C. for 15 minutes.

There resulted carrier particles containing a coating of the copolymer, in a thickness of 0.30 microns, which coating contained therein, on 10 percent of its surface area, the polyvinylidene fluoride.

A developer mixture was prepared by mixing for about 25 minutes, 100 parts by weight of the above prepared carrier particles, with 2 parts by weight of a toner composition prepared by melt blending 92 parts by weight of a styrene n-butylmethacrylate copolymer resin, 58 percent by weight of styrene, 42 percent by weight of n-butylmethacrylate, 2 parts by weight of cetyl pyridinium chloride, a known charge enhancing additive, and 6 parts by weight of Regal 330 carbon black, which toner was micronized to a 12 micron volume average diameter. The toner particles were of a positive polarity of 25 microcoulombs per gram as measured on a charge spectrograph in accordance with the procedure described hereinafter.

When uncharged toner particles comprised of 92 parts by weight of a styrene n-butylmethacrylate copolymer resin, (58/42), 2 parts by weight of cetyl pyridinium chloride, a known charge enhancing additive, and 6 parts by weight of carbon black are added to the above prepared developer mixture, the admix charging rate was about 15 seconds that is the new uncharged toner particles acquired a positive charge of 25 microcoulombs per gram in 15 seconds. The amount of charge acquired and the time within which it was acquired was measured on a toner charge spectrograph. This instrument disperses toner particles in proportion to their charge/diameter, and with the aid of automated microscopy can generate charge distribution histograms or curves for selected toner size classes. Use of the spectrograph allows the monitoring of the admixed toner charging rates. Should the admix rates be too slow, the uncharged toner will form a second peak in the distribution curves. Charge distribution time sequences can thus be used to distinguish between slow and rapid admix charging rates, reference U.S. Pat. No. 4,378,420, the disclosure of which is totally incorporated herein by reference.

When the above developer mixture containing uncharged toner particles is selected for use in a xerographic imaging system, wherein the photoreceptor is selenium, charged negatively there was immediately obtained after one imaging cycle images of high quality and excellent resolution, indicating that the new uncharged toner particles had rapidly acquired the appropriate level of charge in 15 seconds.

In contrast, when the above-prepared developer composition, with the exception that it did not contain in the carrier coating the polyvinylidene fluoride particles, was used for the purpose of charging uncharged toner particles, these particles did not acquire the appropriate charge, for about 4 minutes or significantly greater than the admix charging rate of about 15 seconds for the developer composition containing polyvinylidene fluoride in the carrier coating.

EXAMPLE II

There was prepared carrier particles by mixing 200 grams of a 100 micron carrier containing a steel core, available from Nuclear Metals Core Corporation, coated with 0.89 grams of a copolymer of vinylidene fluoride and vinylacetate, commercially available as FPC-461 from Occidental Petroleum, with 1.0 grams (5 percent) of polyvinylidene fluoride, commercially available as Kynar 301. Mixing was continued for 30 minutes and subsequently the resulting carrier particles were heated in an oven at 100° C. for 15 minutes.

There resulted carrier particles containing a coating of the copolymer, in a thickness of 0.30 microns, which coating contained therein, on 20 percent of its surface area, the polyvinylidene fluoride.

A developer mixture was prepared by mixing for about 30 minutes, 100 parts by weight of the above prepared carrier particles, with 2 parts by weight of a toner composition prepared by melt blending 92 parts by weight of a styrene n-butylmethacrylate copolymer resin, 58 percent by weight of styrene, 42 percent by weight of n-butylmethacrylate, 2 parts by weight of cetyl pyridinium chloride, and 6 parts by weight of Regal 330 carbon black, which toner was micronized to a 12 micron volume average diameter. The toner particles were of a positive polarity of 25 microcoulombs per gram as measured on a charge spectrograph in accordance with the procedure described hereinafter.

When uncharged toner particles comprised of 92 parts by weight of a styrene n-butylmethacrylate copolymer resin, (58/42), 2 parts by weight of cetyl pyridinium chloride, and 6 parts by weight of carbon black are added to the above prepared developer mixture, the admix charging rate was about 15 seconds, that is the new uncharged toner particles acquired a positive charge of 25 microcoulombs per gram in 15 seconds. The amount of charge acquired and the time within which it was acquired was measured on a toner charge spectrograph. This instrument disperses toner particles in proportion to their charge/diameter, and with the aid of automated microscopy can generate charge distribution histographs or curves for selected toner size classes. Use of the spectrograph allows the monitoring of the admixed toner charging rate. Should the admix rates be too slow, the uncharged toner will form a second peak in the distribution curves. Charge distribution time sequence can thus be used to distinguish between slow and rapid admix charging rates, reference U.S. Pat. No. 4,378,420, the disclosure of which is totally incorporated herein by reference.

When the above developer mixture containing uncharged toner particles is selected for use in a xerographic imaging system, wherein the photoreceptor is selenium, charged negatively there was immediately obtained after one imaging cycle images of high quality and excellent resolution, indicating that the new uncharged toner particles had rapidly acquired the appropriate level of charge in 15 seconds.

In contrast, when the above-prepared developer composition, with the exception that it did not contain in the carrier coating the polyvinylidene fluoride particles, was used for the purpose of charging uncharged toner particles, these particles did not acquire the appropriate charge, for about 4 minutes or significantly greater than the admix charging rate of about 15 seconds for the developer composition containing polyvinylidene fluoride in the carrier coating.

Although the invention has been described with reference to specific preferred embodiments, it is not intended to be limited thereto, rather those skilled in the art will recognize that variations and modifications may be made therein which are within the spirit of the invention and within the scope of the claims.

We claim:

1. An improved process for rapidly charging toner particles wwhich comprises providing uncharged and charged toner particles having incorporated therein resin particles and pigment particles, and thereafter (I) adding uncharged replenishment toner particles to an imaging apparatus with charged developer composition contained therein comprised of carrier particles and toner particles, the carrier particles consisting of a core containing a continuous polymer coating thereover having incorporated therein a fluoropolymer, present on from about 1 percent to about 20 percent of the surface area of the carrier, (II) contacting the charged developing composition containing said carrier particles with the uncharged toner particles wherein charges are transferred to the uncharged toner particles within a mixing period of from about 5 seconds to about 5 minutes, thereby resulting in substantially the same level of charge intensity for said uncharged toner particles as the charge intensity for the charged toner particles in the charged developer composition.

2. A process in accordance with claim 1 wherein the charge intensity is from about 5 microcoulombs per gram to about 50 microcoulombs per gram of toner particles.

3. A process in accordance with claim 1 wherein the fluoropolymer is polyvinylidene fluoride.

4. A process in accordance with claim 1 wherein the continuous polymer coating is comprised of a copolymer of vinylchloride and vinylacetate, or a terpolymer of styrene, methylmethacrylate, and triethoxy silane.

5. A process in accordance with claim 1 wherein the carrier core is comprised of steel, nickel, iron or ferrites.

6. A process in accordance with claim 1 wherein the toner composition is comprised of a styrene n-butylmethacrylate copolymer containing therein pigment particles, or a styrenebutadiene copolymer containing therein pigment particles.

7. A process in accordance with claim 6 wherein the pigment particles are carbon black.

8. A process in accordance with claim 1 wherein the uncharged toner particles acquire a positive polarity.

9. A method for developing electrostatic latent images contained on an imaging member which comprises forming an electrostatic latent image on an insulating photoconductive material, contacting the image with a charged developer composition comprised of carrier particles and toner particles, having added thereto uncharged replenishment developer particles, the carrier particles consisting of a core containing a continuous polymeric coating, containing on its surface a fluoropolymer additive, said additive being present on the surface of the coating in an amount of from about 1 percent to about 20 percent, wherein charges are transferred to the uncharged toner particles with a mixing time of from about 5 seconds to about 5 minutes, transferring the developed image to a permanent substrate, and subsequently permanently fusing thereon.

10. A method of imaging in accordance with claim 9 wherein the charge intensity is from about 5 microcoulombs per gram to about 50 microcoulombs per gram.

11. A method of imaging in accordance with claim 9 wherein the fluoropolymer is polyvinylidene fluoride.

12. A method of imaging in accordance with claim 9 wherein the continuous coating is comprised of a copolymer of vinylchloride and vinylacetate, or a terpolymer of styrene, methylmethacrylate, and triethoxy silane.

13. A method of imaging in accordance with claim 9 wherein the carrier core is comprised of steel, nickel, iron or ferrites.

14. A process in accordance with claim 1 wherein the fluoropolymer is present on the continuous coating in an amount of from about 0.005 to about 0.25 percent by weight.

15. A process in accordance with claim 1 wherein the fluoropolymer is of a thickness of from about 0.2 microns to about 0.6 microns.

16. An improved process for rapidly charging uncharged replenishment toner particles to a positive polarity which consists of providing uncharged and charged toner particles containing resin particles and pigment particles, and thereafter adding the uncharged replenishment toner particles to an imaging apparatus containing a positively charged developer composition comprised of carrier particles and toner particles, wherein the carrier particles consist of a core with a polymeric overcoating of polyvinylidene fluoride, present on the surface thereof in an amount of from about 0.005 percent by weight to about 0.25 percent by weight, wherein positive charges are transferred to the uncharged toner particles within a mixing period of from about 5 seconds to about 5 minutes, thereby resulting in substantially the same level of charge intensity for the uncharged toner particles as the charge intensity for the charged particles in the charged developer composition which charge intensity is from about 5 microcoulombs per gram to about 50 microcoulombs per gram.

* * * * *